US012808310B1

(12) United States Patent
Lawrence et al.

(10) Patent No.: US 12,808,310 B1
(45) Date of Patent: Nov. 24, 2026

(54) CRANKCASE VENTILATION SYSTEM AND FILTER ASSEMBLY THEREFOR

(71) Applicant: Caterpillar Inc., Peoria, IL (US)

(72) Inventors: Rodney Lawrence, Frankfort, IN (US); Lucas Smith, Lafayette, IN (US); Brandyn A. Stack, Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 19/252,130

(22) Filed: Jun. 27, 2025

(51) Int. Cl.
*F01M 13/04* (2006.01)
*F01M 11/00* (2006.01)

(52) U.S. Cl.
CPC ..... *F01M 13/04* (2013.01); *F01M 11/0004* (2013.01); *F01M 2013/0438* (2013.01)

(58) Field of Classification Search
CPC ..... F01M 13/0004; F01M 13/04; F01M 2013/0427; F01M 2013/045; F01M 2013/0433; F01M 2013/005; F01M 2013/0016; F01M 2013/0061; F01M 2013/0438; F01M 2013/0488; F01M 11/0004; F01M 2013/0472; F02M 25/06
USPC ..... 123/41.86, 572–574
See application file for complete search history.

(56) References Cited

U.S. PATENT DOCUMENTS 5,586,996 A * 12/1996 Manookian, Jr. .. B01D 46/2411 123/573
6,161,529 A 12/2000 Hannifin
6,907,869 B2 6/2005 Burgess et al.
6,918,939 B2 * 7/2005 Dworatzek ..... B01D 46/0087 210/450
7,614,390 B2 11/2009 Holzmann et al.
8,404,014 B2 3/2013 Donaldson
9,574,469 B2 * 2/2017 Dawar ..... F01M 13/04
9,702,282 B2 * 7/2017 Peck ..... F01M 13/04
9,771,842 B2 * 9/2017 An ..... F01M 13/04
10,132,217 B2 11/2018 Lawence et al.
11,318,403 B2 * 5/2022 Wankhede ..... F02D 33/003
11,612,834 B2 3/2023 Wieczorek et al.
2004/0083692 A1 * 5/2004 Dworatzek ..... B01D 46/24 55/498
2009/0071111 A1 * 3/2009 Lundgren ..... F01M 13/04 55/385.4
2009/0242470 A1 10/2009 Muenkel et al.
2011/0180051 A1 * 7/2011 Schwandt ..... F01M 13/023 123/573
2012/0318215 A1 * 12/2012 Copley ..... B01D 45/08 123/41.86
2014/0165977 A1 * 6/2014 Copley ..... B01D 45/16 123/573
2017/0276040 A1 * 9/2017 Lawrence ..... F01M 13/04

FOREIGN PATENT DOCUMENTS

WO 2024087716 A1 5/2024

* cited by examiner

*Primary Examiner* — Hai H Huynh
*Assistant Examiner* — Johnny H Hoang

(57) ABSTRACT

A crankcase ventilation system includes an oil separator having a filter assembly arranged between a blowby inlet and an outlet to coalesce oil in engine blowby for draining to an oil sump. A filter end cap of the filter assembly forms a coalesced oil collection channel receiving an end of a filter element, and a baffle extending to an inner housing surface of the oil separator limiting opportunity for boost air to backflow into a drain trough of the oil sump to produce oil aerosols. Related filter element and filter end cap apparatus is also disclosed.

20 Claims, 3 Drawing Sheets

CRANKCASE VENTILATION SYSTEM AND FILTER ASSEMBLY THEREFOR

TECHNICAL FIELD

The present disclosure relates generally to crankcase ventilation, and more particularly to strategies for limiting undesired oil aerosol formation in an oil separator of a crankcase ventilation system.

BACKGROUND

Internal combustion engines are widely used throughout the world for diverse purposes ranging from operating a driveline in a land vehicle or a marine vessel, to operating pumps, compressors, and electrical generators to name a few examples. During the course of operation, fluid pressure within engine cylinders can result in some fluids being urged between piston rings and cylinder walls to enter the engine crankcase in a phenomenon referred to as "blowby." The blowby fluids are generally desirable to ventilate from the crankcase. Engine oil is often carried in the blowby fluids, and it is desirable to capture the engine oil instead of discharging it to atmosphere.

A variety of crankcase ventilation technologies are known. One type of crankcase ventilation system employs excess turbocharger boost to operate or assist in operating an oil separator in a crankcase ventilation system. A variety of boost-assisted impactor technologies are available commercially for use in high efficiency oil separators, notably in connection with diesel engines. Existing strategies exhibit a variety of attributes that could be improved upon and/or performed alternatively. One known crankcase ventilation system is set forth in U.S. Pat. No. 10,132,217 to Lawence et al.

SUMMARY OF THE INVENTION

In one aspect, a crankcase ventilation system includes an oil separator having a housing with an inner housing surface forming a cavity, a boost inlet, a blowby inlet, and an outlet. A filter assembly is in the cavity and includes a filter medium defining a center axis and arranged in a flow path between the blowby inlet and the outlet, and a filter end cap defining an oil collection channel and receiving the filter medium in the oil collection channel. The oil separator further includes an oil sump extending circumferentially around the center axis. The filter end cap further includes a baffle extending to the inner housing surface, and a plurality of weep holes extending from the oil collection channel to drain oil coalesced on the filter medium and drained under the force of gravity through the oil collection channel to the oil sump.

In another aspect, a filter assembly for an oil separator in a crankcase ventilation system includes an elongate filter medium defining a center axis extending between a first medium end and a second medium end, and having an inner medium surface forming a central passage to receive an incoming flow of blowby gases to be filtered, and an outer medium surface. The filter assembly also includes a filter end cap forming a coalesced oil collection channel receiving the second medium end, and having a peripheral baffle projecting outward and extending circumferentially around the center axis. The peripheral baffle includes a baffle inner surface in sealed contact with the elongate filter medium. A plurality of weep holes are formed in the end cap to drain oil from the coalesced oil collection channel.

In still another aspect, an end cap for a filter assembly includes an end cap body defining a center axis, and having a first axial end cap end, a second axial end cap end, and a central opening extending axially through the end cap body. The end cap body further includes a radially outward end cap wall and a radially inward end cap wall, and an oil collection channel defined between the radially outward end cap wall and the radially inward end cap wall. The end cap body further includes an integral peripheral baffle extending circumferentially around the center axis and projecting radially outward. The radially outward end cap wall extends in an axial direction, and the integral peripheral baffle includes an inner surface oriented at an angle to the center axis and advancing radially outward from the radially outward end cap wall in a direction of the first axial end cap end. A plurality of weep holes are formed in the second axial end cap end to drain oil from the oil collection channel.

DETAILED DESCRIPTION

Figure 1:
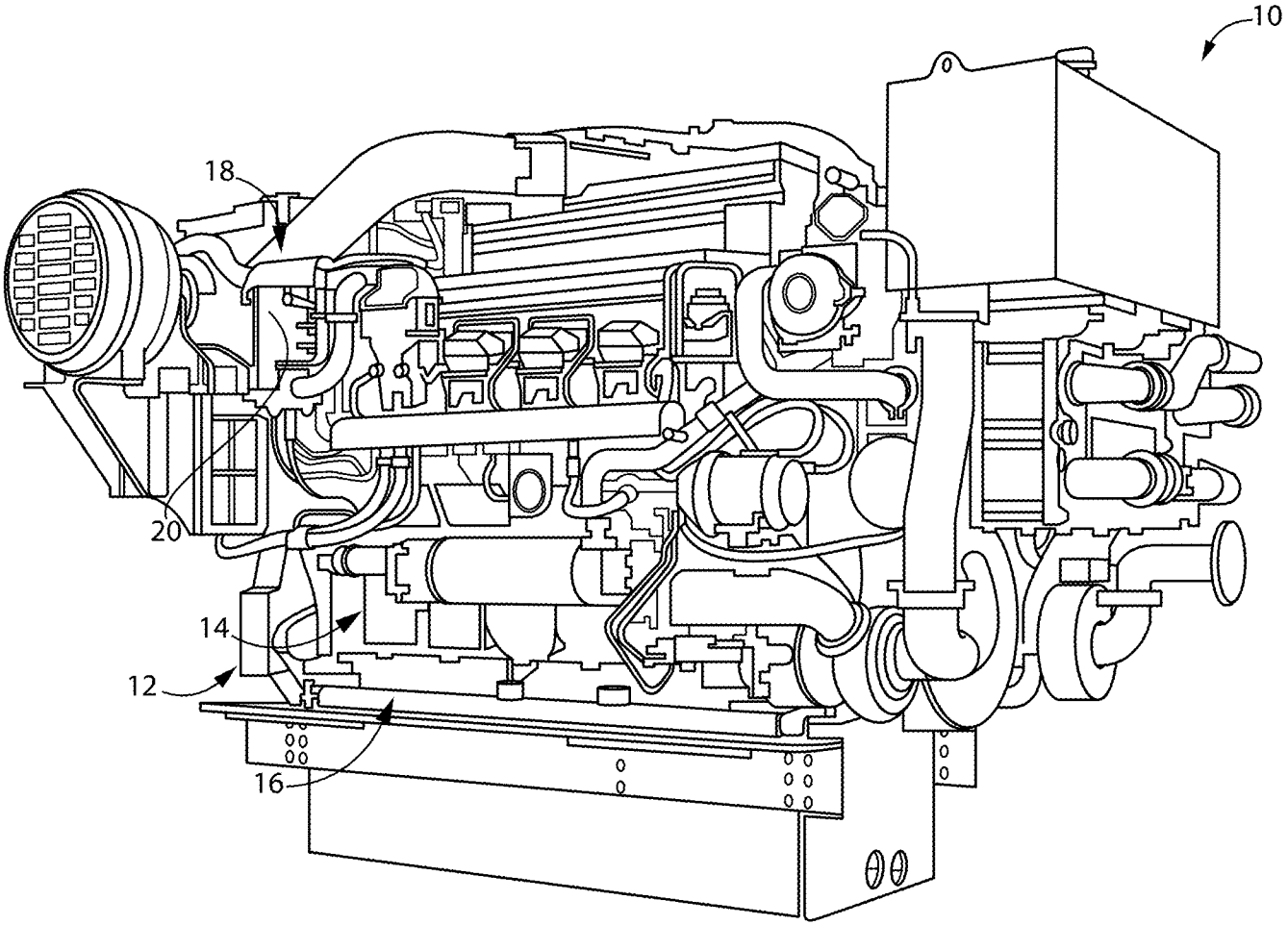
FIG. 1 is a diagrammatic view of an internal combustion engine system, according to one embodiment.

Referring to FIG. 1, there is shown an internal combustion engine system 10, according to one embodiment. Engine system 10 includes an internal combustion engine 12 having an engine housing 14. Engine housing 14 will include a plurality of engine cylinders therein equipped with a plurality of pistons in a generally conventional manner. Engine 12 may include a compression-ignition engine, operable on a suitable compression-ignition fuel such as a diesel distillate fuel, typically in a four-stroke engine cycle. Engine system 10 can be used in any known application including, for example, operating a driveline in a vehicle, operating an electrical generator, or operating a pump or a compressor. In one particular example, engine system 10 can be used to operate a pump in a so-called hydraulic fracturing environment.

Engine housing 14 also includes a crankcase 16, and a crankcase ventilation system 18. Crankcase ventilation system 18 can be operated to remove crankcase gases, such as is known, utilizing positive pressure, vacuum, or combinations thereof. Crankcase ventilation system 18 is further structured to separate and collect engine oil carried in blowby gases so as to avoid discharging to atmosphere and potentially drain the collected engine oil back to an engine oil pan.

Figure 2:
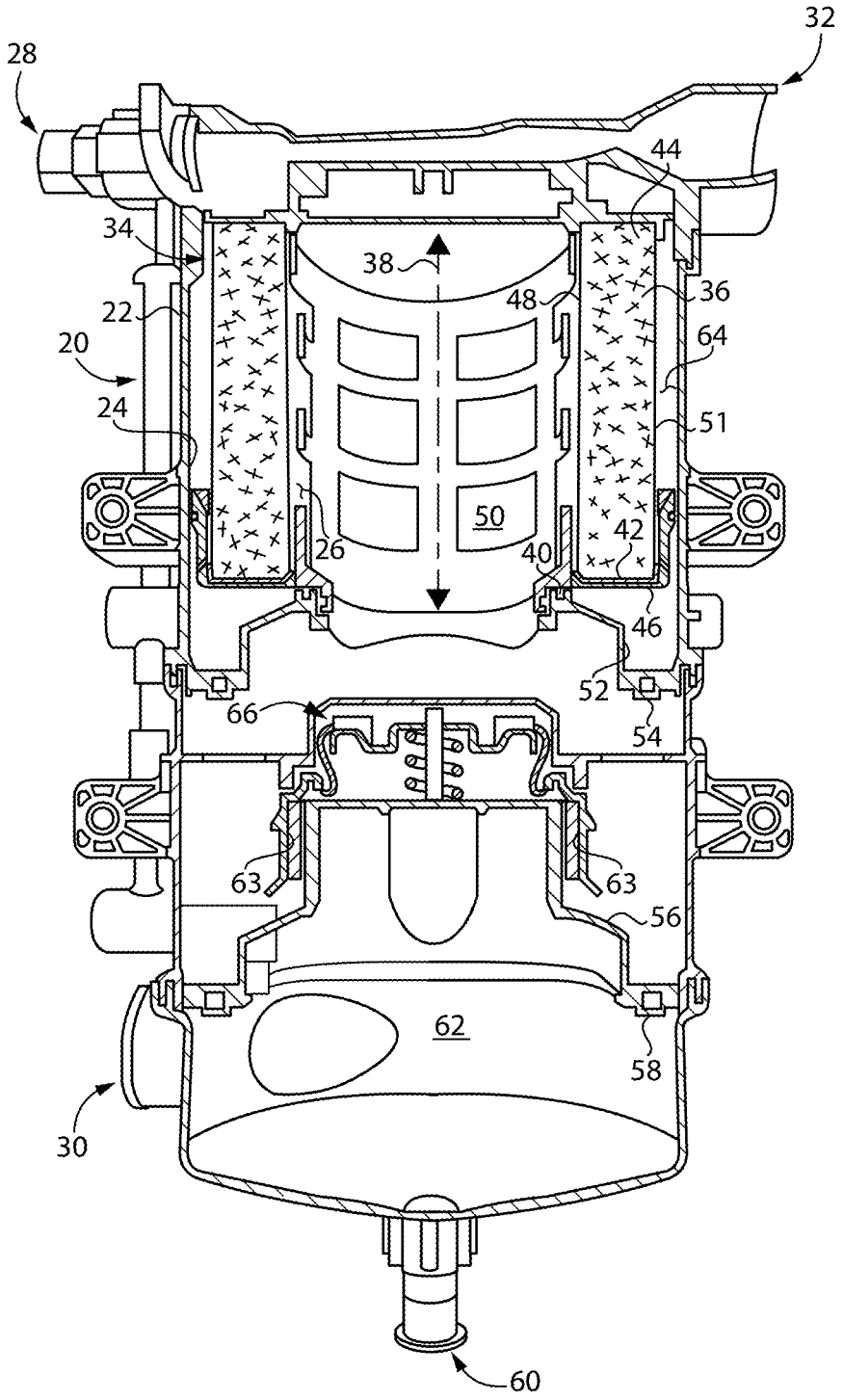
FIG. 2 is a sectioned side diagrammatic view of an oil separator for a crankcase ventilation system, according to one embodiment.

To this end, crankcase ventilation system 18 includes an oil separator 20. Referring also now to FIG. 2, oil separator 20 is shown in a sectioned view, and includes a housing 22 configured as one or more housing pieces, having an inner housing surface 24 forming a cavity 26. Housing 22 also includes a boost inlet 28 receiving a feed of pressurized air typically from a turbocharger in engine system 10, a blowby inlet 30, and an outlet 32. Oil separator 20 may operate at least in part by way of eduction employing a flow of pressurized boost air producing a vacuum by way of the well-known Venturi effect. The present disclosure is not limited with regard to any particular air flow, vacuum, or other strategy for operating an oil separator in a crankcase ventilation system 18.

Oil separator 20 further includes a filter assembly 34 in cavity 26 having a filter medium 36 defining a center axis 38 and arranged in a flow path between blowby inlet 30 and outlet 32. Filter assembly 34 also includes a filter end cap 40 defining a coalesced oil collection channel 42 and receiving filter medium 36 in coalesced oil collection channel 42.

Filter assembly 34 includes filter medium 36 as noted above. Filter medium 36 can be formed of any suitable material, although in a practical implementation will be formed of a material suited for non-absorptive coalescing of oil droplets carried in a flow of blowby gases as is known and commercially available. Filter medium 36 may be elongate and generally cylindrical including a first medium end 44 and a second medium end 46. Filter medium 36 further includes an inner medium surface 48 forming a central passage 50 to receive an incoming flow of blowby gases to be filtered, and an outer medium surface 51.

Oil separator 20 further includes an oil sump 52 having a drain trough 54. Oil sump 52 and drain trough 54 will typically extend at least partially circumferentially around center axis 38. As further discussed herein, oil coalesced on filter medium 36 can drain under the force of gravity into oil collection channel 42, and thenceforth into oil sump 52 and into drain trough 54 for further draining and collection. Oil sump 52 may, in some embodiments, be understood as a coalescing filter oil sump. Oil separator 20 may also include a second oil sump 56, understood as a variable geometry impactor oil sump, and having a second drain trough 58 generally analogously configured to oil sump 52 and drain trough 54.

Oil separator 20 may further include an inlet chamber 62 receiving a flow of blowby gases through blowby inlet 30. Within chamber 62 blowby gases carrying oil may experience a cyclonic flow generally circumferentially around center axis 38. The cyclonically flowing blowby gases can then travel upwardly in oil separator 20 and out through openings 63. A variable geometry impactor 66 operated on the basis of a differential pressure between a boost pressure and atmospheric pressure according to known techniques assists in movement of the blowby gases through openings 63. Oil carried in the blowby gases can fall out in oil sump 56 and is ultimately collected and routed away from the oil separator, such as by way of a drain port 60 coupled to housing 22. From the vicinity of oil sump 56 the blowby gases travel upwardly and into central passage 50 of filter medium 36, then outwardly through filter medium 36 to a clearance 64 defined between outer surface 51 and inner housing surface 24. The oil in the blowby gases passing through filter medium 36 tends to coalesce on filter medium 36, and drain under the force of gravity down through filter medium 36 and into oil collection channel 42. The cleaned blowby gases having passed through filter medium 36 are thenceforth conveyed to outlet port 32.

It has been discovered that a potential exists with certain conventional designs for boost air to backflow down into an oil drain trough generally analogous to drain trough 54, and then up into oil sump 46 and potentially creating oil aerosols. The oil aerosols could theoretically be conveyed through exit clearance 64 or other passages to outlet port 32 and end up being discharged. Filter assembly 34 can be configured to address these and other concerns, as further discussed herein.

Figure 3:
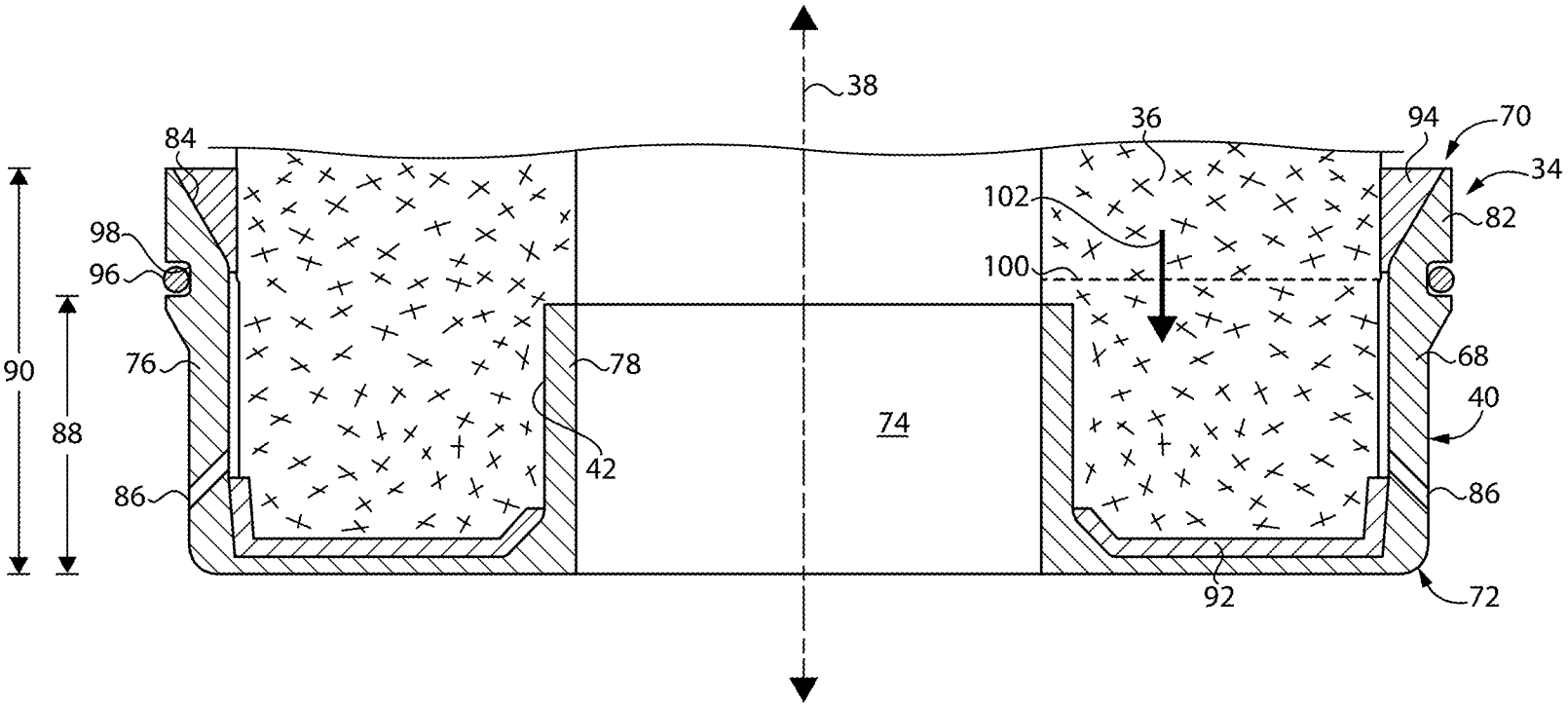
FIG. 3 is a sectioned side diagrammatic view of a filter assembly for an oil separator, according to one embodiment.

Referring also now to FIG. 3, end cap 40 may include an end cap body 68. End cap body 68 and end cap 40 are referred to herein, at times, interchangeably. End cap body 68 can be understood to define a center axis coaxial with center axis 38 defined by filter medium 36. End cap body 68 includes a first axial end cap end 70, a second axial end cap end 72, and a central opening 74 that receives the flow of blowby gases and extends axially through end cap body 68. End cap body 68 further includes a radially outward end cap wall 76 and a radially inward end cap wall 78. Oil collection channel 80 is defined between radially outward end cap wall 76 and radially inward end cap wall 78.

End cap body 68 further includes a peripheral baffle 82. End cap body 68 may be formed as a one-piece monolithic part, molded, for example, from a suitable non-metallic material. Peripheral baffle 82 may be formed integrally in end cap body 68, although the present disclosure is not thereby limited. Peripheral baffle 82 extends circumferentially around center axis 38 and projects radially outward. Peripheral baffle 82 may extend to and contact inner housing surface 24. Extending into contact with inner housing surface 24 can enable peripheral baffle 82 to effectively seal in such a way that the above-mentioned backflow and oil aerosol formation phenomena are reduced or eliminated.

Radially outward end cap wall 76 extends in an axial direction, generally parallel to center axis 38, and peripheral baffle 82 may include an inner surface 84 oriented at an angle to center axis 38 and advancing radially outward from radially outward end cap wall 78 in a direction of first axial end cap end 70. The sloping orientation of surface 84 is readily apparent in FIG. 3. A plurality of oil weep holes 86 are formed in second axial end cap end 72. In the illustrated embodiment, the weep holes 86 are formed in radially outward end cap wall 76 and are angled from oil collection channel 80 axially downward and radially outward. It can further be noted from FIG. 3 that oil collection channel has a depth 88. Depth 88 may be equal to at least a majority of a full axial length 90 of end cap body 68 in some embodiments.

As noted, surface 84 may be sloped or angled relative to center axis 38. Surface 84 could be conical. It will be recalled filter medium 36 is received in oil collection channel 42. In an embodiment, an adhesive 92 attaches second medium end 46 to end cap 40 within oil collection channel 42. A second adhesive 94 may attach filter medium 36 to peripheral baffle 82. Weep holes 86 may open to oil collection channel 42 at locations that are axially between peripheral baffle 82 and adhesive 92, attaching second filter medium end 46 to end cap 40 within oil collection channel 42.

It will be also recalled that peripheral baffle 82 can substantially seal with inner housing surface 24. Embodiments are contemplated wherein a wiper seal or the like is part of or attached to peripheral baffle 82. In the illustrated embodiment a sealing element 96 such as an O-ring seal is seated in a circumferential sealing groove 98 formed in peripheral baffle 82.

INDUSTRIAL APPLICABILITY

Referring to the drawings generally, but still focusing on FIG. 3, during operation oil carried in blowby gases may coalesce on filter medium 36, and drain under the force of gravity down through filter medium 36 into oil collection channel 42. FIG. 3 shows arrow 102 indicating an approximate direction of draining of coalesced oil. Numeral 100 shows an approximate oil wet line corresponding to a wetted portion of filter medium 36. It will be appreciated that peripheral baffle 82 contacts inner housing surface 24 above oil wet line 100 in the illustrated embodiment. It will also be appreciated that the location and placement of peripheral baffle 82 assists in limiting fluid communication between clearance 64 and oil sump 52 that could ultimately result in suction that pulls oil aerosol up into clearance 64 as discussed herein. The present disclosure provides a crankcase ventilation system, filter assembly, and end cap that could be sold as an add-on apparatus to an existing engine platform. Any of a filter assembly, end cap, or assembled oil separator could also be made commercially available.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise

What is claimed is:

1. A crankcase ventilation system comprising:

an oil separator including a housing having an inner housing surface forming a cavity, a boost inlet, a blowby inlet, and an outlet, a filter assembly in the cavity and having a filter medium defining a center axis and arranged in a flow path between the blowby inlet and the outlet, and a filter end cap defining an oil collection channel and receiving the filter medium in the oil collection channel;

the oil separator further including an oil sump extending circumferentially around the center axis; and the end cap further including a baffle extending to the inner housing surface, and a plurality of weep holes extending from the oil collection channel to drain oil coalesced on the filter medium and drained under the force of gravity through the oil collection channel to the oil sump.

2. The crankcase ventilation system of claim 1 wherein the oil collection channel is formed between a radially outward end cap wall and a radially inward end cap wall and receives an end of the filter medium.

3. The crankcase ventilation system of claim 2 wherein the plurality of weep holes include a plurality of angled weep holes formed in the radially outward end cap wall.

4. The crankcase ventilation system of claim 2 further comprising an adhesive attaching the end of the filter medium to the end cap within the oil collection channel.

5. The crankcase ventilation system of claim 4 further comprising a second adhesive attaching the filter medium to the peripheral baffle, and wherein the plurality of weep holes open to the oil collection channel at locations that are axially between the peripheral baffle and the adhesive attaching the end of the filter medium to the end cap within the oil collection channel.

6. The crankcase ventilation system of claim 2 wherein a cleaned blowby exit clearance extends circumferentially around the center axis and is defined between the filter medium and the inner housing surface.

7. The crankcase ventilation system of claim 6 further comprising a sealing element coupled to the peripheral baffle and forming a fluid seal with the inner housing surface fluidly between the cleaned blowby exit clearance and the oil sump.

8. The crankcase ventilation system of claim 1 wherein the oil sump includes a first oil sump, and the oil separator includes a second oil sump arranged in the fluid flow path fluidly between the first oil sump and the blowby inlet.

9. The crankcase ventilation system of claim 8 wherein the first oil sump includes a coalescing filter oil sump, and the second oil sump includes a variable geometry impactor oil sump.

10. A filter assembly for an oil separator in a crankcase ventilation system comprising:

an elongate filter medium defining a center axis extending between a first medium end and a second medium end, and including an inner medium surface forming a central passage to receive an incoming flow of blowby gases to be filtered, and an outer medium surface;

an end cap forming a coalesced oil collection channel receiving the second medium end, and including a peripheral baffle projecting outward and extending circumferentially around the center axis;

the peripheral baffle including a baffle inner surface in sealed contact with the elongate filter medium; and a plurality of weep holes are formed in the end cap to drain oil from the coalesced oil collection channel.

11. The filter assembly of claim 10 wherein the baffle inner surface is in sealed contact with the elongate filter medium at a sealing location that is axially above the coalesced oil collection channel.

12. The filter assembly of claim 10 further comprising a first adhesive establishing the sealed contact of the baffle inner surface with the elongate filter medium, and a second adhesive attaching the second medium end to the end cap within the oil collection channel.

13. The filter assembly of claim 10 wherein the oil collection channel is defined between a radially outward end cap wall and a radially inward end cap wall, and the plurality of weep holes are formed in the radially outward end cap wall.

14. The filter assembly of claim 13 wherein the plurality of weep holes are angled radially outward and axially downward from the oil collection channel.

15. The filter assembly of claim 10 further comprising a sealing element coupled to the peripheral baffle.

16. The filter assembly of claim 15 wherein the sealing element includes an O-ring seated in a groove in the peripheral baffle.

17. An end cap for a filter assembly comprising:

an end cap body defining a center axis, and including a first axial end cap end, a second axial end cap end, and a central opening extending axially through the end cap body;

the end cap body further including a radially outward end cap wall and a radially inward end cap wall, and an oil collection channel defined between the radially outward end cap wall and the radially inward end cap wall;

the end cap body further including an integral peripheral baffle extending circumferentially around the center axis and projecting radially outward;

the radially outward end cap wall extending in an axial direction, and the integral peripheral baffle including an inner surface oriented at an angle to the center axis and advancing radially outward from the radially outward end cap wall in a direction of the first axial end cap end; and a plurality of weep holes are formed in the second axial end cap end to drain oil from the oil collection channel.

18. The end cap of claim 17 wherein the plurality of weep holes are formed in the radially outward end cap wall.

19. The end cap of claim 18 wherein the plurality of weep holes include a plurality of angled weep holes.

20. The end cap of claim 17 wherein the oil collection channel has a depth equal to at least a majority of a full axial length of the end cap body.

* * * * *